US010659902B2

(12) United States Patent
Devallez et al.

(10) Patent No.: US 10,659,902 B2
(45) Date of Patent: May 19, 2020

(54) METHOD AND SYSTEM OF BROADCASTING A 360° AUDIO SIGNAL

(71) Applicant: ARKAMYS, Paris (FR)

(72) Inventors: Delphine Devallez, Boulogne-Billancourt (FR); Frédéric Amadu, Chelles (FR)

(73) Assignee: ARKAMYS, Paris (FR)

( * ) Notice: Subject to any disclaimer, the term of this patent is extended or adjusted under 35 U.S.C. 154(b) by 0 days.

(21) Appl. No.: 16/096,339

(22) PCT Filed: Apr. 20, 2017

(86) PCT No.: PCT/FR2017/050935

§ 371 (c)(1),
(2) Date: Oct. 25, 2018

(87) PCT Pub. No.: WO2017/187053

PCT Pub. Date: Nov. 2, 2017

(65) Prior Publication Data

US 2019/0132695 A1 May 2, 2019

(30) Foreign Application Priority Data

Apr. 26, 2016 (FR) ..... 16 53684

(51) Int. Cl.
*H04R 5/00* (2006.01)
*H04S 7/00* (2006.01)
(Continued)

(52) U.S. Cl.
CPC ..... *H04S 7/302* (2013.01); *H04R 1/406* (2013.01); *H04R 3/005* (2013.01); *H04S 7/304* (2013.01);
(Continued)

(58) Field of Classification Search
CPC ... H04S 7/00; H04S 7/30; H04S 7/301; H04S 7/302; H04S 7/303; H04S 7/304;
(Continued)

(56) References Cited

U.S. PATENT DOCUMENTS 6,021,206 A 2/2000 McGrath
6,259,795 B1 * 7/2001 McGrath ..... H04S 7/304 381/18
(Continued)

FOREIGN PATENT DOCUMENTS

WO 2005015954 2/2005
WO WO-2005015954 A2 * 2/2005 ..... H04R 5/027
WO 2015128160 3/2015

OTHER PUBLICATIONS

International Search Report for PCT/FR2017/050935 dated Jun. 27, 2017.
(Continued)

*Primary Examiner* — Leshui Zhang
(74) *Attorney, Agent, or Firm* — Perman & Green, LLC

(57) ABSTRACT

A system and method of processing a sound signal. The method of processing a sound signal that includes the following steps: Synchronous reception of an input sound signal ($S_{input}$) of N microphones, N being a natural number greater than or equal to three; Encoding of the input sound signal ($S_{input}$) in a data format (D) of sound, the encoding including a sub-step of transforming the input signal into an ambisonic format of order R, R being a natural number greater than or equal to one, the sub-step of transformation into an ambisonic format is carried out by a Fast Fourier Transform, a matrix multiplication, an Inverse Fast Fourier Transform and by a band pass filter; and Return of an output sound signal ($S_{output}$) by digital processing of the sound data (D).

8 Claims, 3 Drawing Sheets

(51) Int. Cl.
*H04R 1/40* (2006.01)
*H04R 3/00* (2006.01)

(52) U.S. Cl.
CPC ..... *H04S 2400/15* (2013.01); *H04S 2420/11* (2013.01)

(58) Field of Classification Search
CPC ..... H04S 7/306; H04S 7/307; H04S 2400/15; H04S 2420/11; H04R 1/40; H04R 1/406; H04R 3/005
USPC .. 381/1, 20, 21, 22, 23, 300, 303, 307, 309, 381/56, 91, 92, 94.2, 94.3, 97, 98, 99, 381/100, 103, 111, 112, 113, 114, 115, 381/119, 122; 700/94
See application file for complete search history.

(56) References Cited

U.S. PATENT DOCUMENTS

2003/0063758 A1* 4/2003 Poletti ..... H04R 3/005 381/91
2012/0093344 A1 4/2012 Sun et al.

OTHER PUBLICATIONS

Laborie A et al "A New Comprehensive Approach of Surround Sound Recording", Audio Engineering Society Convention Paper, New York, NY, US, Mar. 22, 2003, pp. 1-20, XP002280618.

* cited by examiner

W

Y

X

W

Y

X

METHOD AND SYSTEM OF BROADCASTING A 360° AUDIO SIGNAL

CROSS REFERENCE TO RELATED APPLICATIONS

This application is the National Stage of International Application No. PCT/FR2017/050935, having an International Filing date of 20 Apr. 2017, which designated the United States of America, and which International Application was published under PCT Article 21(2) as WO Publication No. 2017/187053 A1, and which claims priority from, and the benefit of, French Application No. 1653684, filed on 26 Apr. 2016, the disclosures of which are incorporated herein by reference in their entireties.

BACKGROUND

1. Field

This disclosed embodiment relates to the field of processing sound signals.

2. Brief Description of Related Developments

Methods and systems are known in the prior art for broadcasting 360° video signals. There is a need in the prior art to be able to combine audio signals with these 360° video signals.

Until now, 3D audio has been reserved for sound technicians and researchers. The purpose of this technology is to acquire as much spatial information as possible during the recording to then deliver this to the listener and provide a feeling of immersion in the audio scene. In the video sector, interest is growing for videos filmed at 360° and reproduced using a virtual reality headset for full immersion in the image: the user can turn his/her head and explore the surrounding visual scene. In order to obtain the same level of precision in the sound sector, the most compact solution involves the use of a network of microphones, for example the Eigenmike by mh acoustics, the Soundfield by TSL Products, and the TetraMic by Core Sound. Equipped with between four and thirty-two microphones, these products are expensive and thus reserved for professional use. Recent research has allowed the number of microphones to be reduced (Palacino, J. D., & Nicol, R. (2013). "Spatial sound pick-up with a low number of microphones." ICA 2013. Montreal, Canada.), and smaller, less expensive microphones can be used, such as those equipping mobile phones. However, the shape of the network of microphones, a polyhedron, remains standard, from the dodecahedron of the EigenMike to the tetrahedron of the Soundfield and TetraMic. This geometric shape allows simple formulae to be used to convert the signals from the microphones into an ambisonic format, and were developed by Gerzon in 1975 (Gerzon, M. (1975). "The design of precisely coincident microphone arrays for stereo and surround sound." $50^{th}$ Audio Engineering Society Conference.). The ambisonic format is a group of audio channels that contains all of the information required for the spatial reproduction of the sound field. One novelty provided by this patent concerns the possibility of using a network of microphones of any shape. Thus, a pre-existing shape, such as that of a 360° camera or a mobile phone, can be used to incorporate a certain number of microphones. A comprehensive and compact 360° image and sound recording system is thus obtained.

SUMMARY

This disclosed embodiment is intended to overcome the drawbacks of the prior art by proposing a method of processing a sound signal allowing the sound signal to be acquired in all directions, then allowing said sound signal to be delivered.

For this purpose, the disclosed embodiment, in the broadest sense thereof, relates to a method of processing a sound signal, characterised in that it comprises the steps of:

- Synchronously acquiring an input sound signal ($S_{input}$) by means of N microphones, N being a natural number greater than or equal to three;
- Encoding the said input sound signal ($S_{input}$) in a sound data format (D), said encoding comprising a sub-step of transforming the said input signal into an ambisonic-type format of order R, R being a natural number greater than or equal to one, the said sub-step of transformation into an ambisonic-type format being carried out by means of a Fast Fourier Transform, a matrix multiplication, an Inverse Fast Fourier Transform and by means of a band-pass filter; and
- Delivering an output sound signal ($S_{output}$) by means of digitally processing the said sound data (D).

Thus, thanks to the method according to this disclosed embodiment, the sound signal can be acquired in all directions, then delivered.

Advantageously, the matrix calculation uses a matrix H calculated by the method of least squares from measured directivities of the N microphones and ideal directivities of the ambisonic components.

According to one aspect of the disclosed embodiment, said microphones are positioned in a circle on a plane, spaced apart by an angle equal to 360°/N or at each corner of a mobile phone.

According to one aspect of the disclosed embodiment, said method implements four microphones spaced apart by an angle of 90° to the horizontal.

According to one aspect of the disclosed embodiment, said method implements a band-pass filter filtering frequencies from 100 Hz to 6 kHz.

According to one aspect of the disclosed embodiment, the order R of the ambisonic-type format is equal to one.

Advantageously, during said delivery step, an information item relative to the orientation of the head of a user listening to the sound signal, is exploited.

Preferably, acquisition of said information item relative to the orientation of the head of a user listening to the sound signal, is carried out by a sensor in a mobile phone or by a sensor located in an audio headset or a virtual reality headset.

According to one aspect of the disclosed embodiment, during said delivery step, the data in ambisonic format is transformed into data in binaural format.

This disclosed embodiment further relates to a sound signal processing system, comprising means for:

- Synchronously acquiring an input sound signal ($S_{input}$) by means of N microphones, N being a natural number greater than or equal to three;
- Encoding the said input sound signal ($S_{input}$) in a sound data format (D), and means for transforming the said input signal into an ambisonic-type format of order R, R being a natural number greater than or equal to one, the said means for transformation into an ambisonic-type format being carried out by means of a Fast Fourier Transform, a matrix multiplication, an Inverse Fast Fourier Transform and by means of a band-pass filter; and Delivering an output sound signal ($S_{output}$) by means of digitally processing the said sound data (D).

BRIEF DESCRIPTION OF THE DRAWINGS

The disclosed embodiment will be better understood after reading the description, provided for illustration purposes only, of one aspect of the disclosed embodiment, with reference to the Figures, in which.

DETAILED DESCRIPTION

This disclosed embodiment relates to a sound signal processing method, comprising the steps of:

Synchronously acquiring an input sound signal $S_{input}$ by means of N microphones, N being a natural number greater than or equal to three;

Encoding the said input sound signal $S_{input}$ in a sound data format D, said encoding comprising a sub-step of transforming the said input signal into an ambisonic-type format of order R, R being a natural number greater than or equal to one, the said sub-step of transformation into an ambisonic-type format being carried out by means of a Fast Fourier Transform, a matrix multiplication, an Inverse Fast Fourier Transform and by means of a band-pass filter; and Delivering an output sound signal $S_{output}$ by means of digitally processing the said sound data D.

Figure 1:
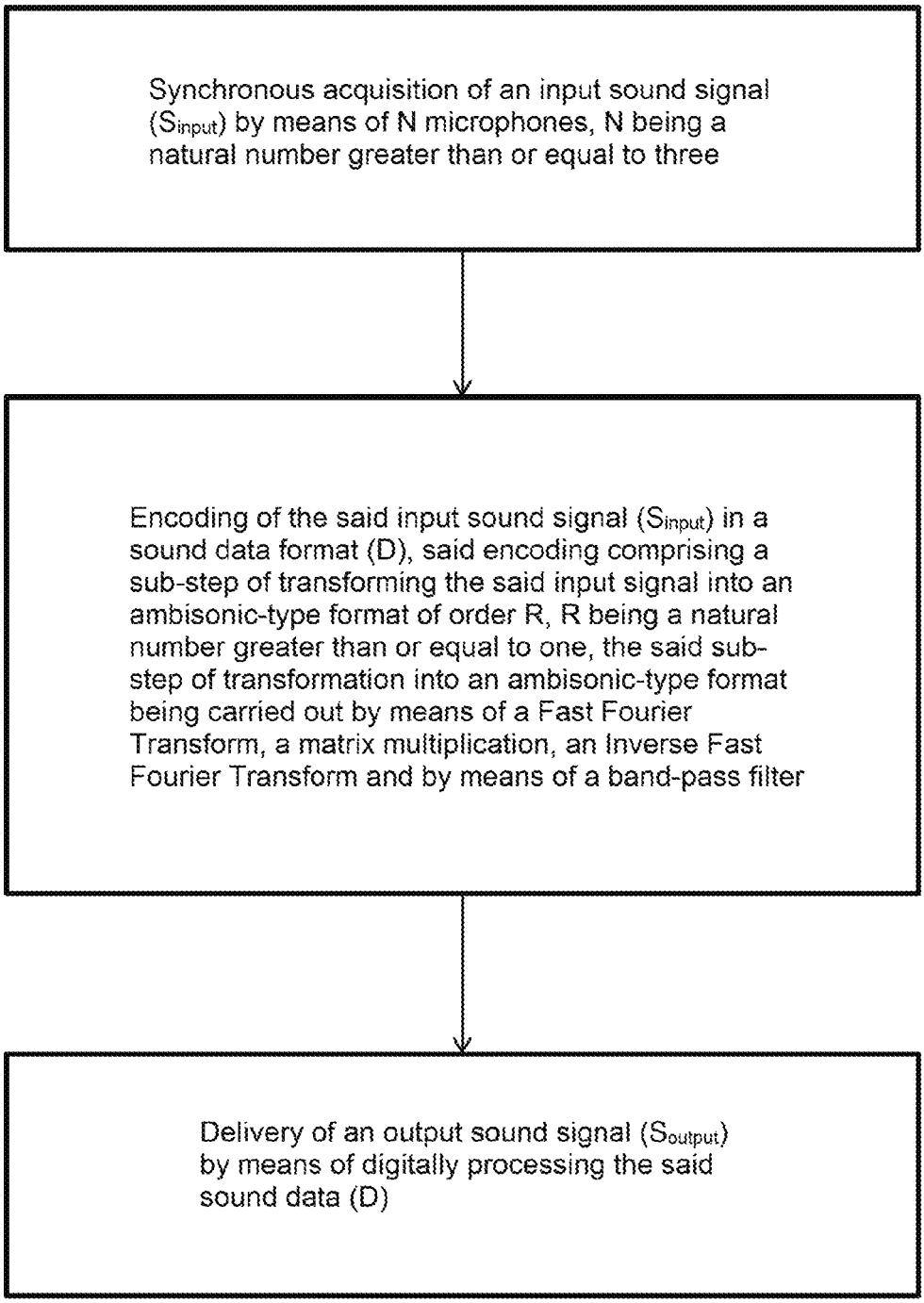
FIGS. 1 and 3 show the different steps of the method according to this disclosed embodiment.
Figure 3:
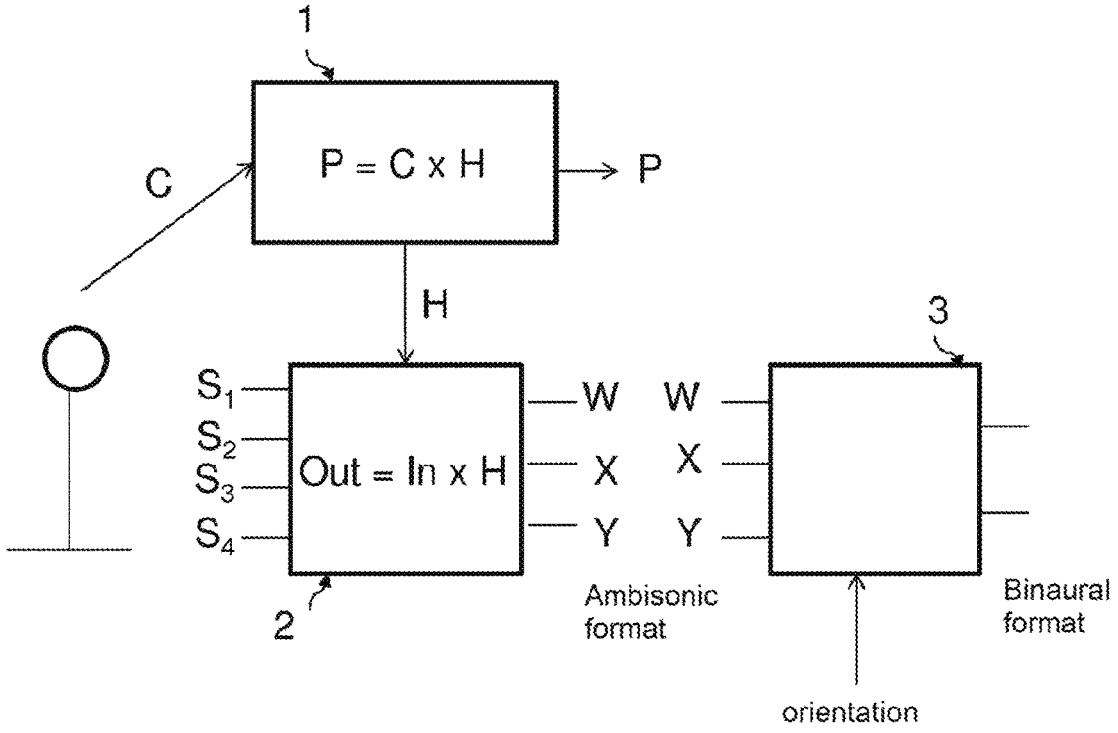

FIGS. 1 and 3 show the different steps of the method according to this disclosed embodiment.

In one aspect of the disclosed embodiment, said microphones are positioned in a circle on a plane, spaced apart by an angle equal to 360°/N or at each corner of a mobile phone.

In one aspect of the disclosed embodiment, the method according to this disclosed embodiment implements four microphones spaced apart by an angle of 90° to the horizontal.

In one aspect of the disclosed embodiment, the order R of the ambisonic-type format is equal to one.

The first step of the method according to this disclosed embodiment consists of recording the sound signal. N microphones are used for this recording, N being a natural number greater than or equal to three, said microphones being positioned in a circle on a plane, spaced apart by an angle equal to 360°/N or at each corner of a mobile phone. In the example aspect of the disclosed embodiment described hereinbelow, N is equal to four and the microphones are spaced 90° apart. These microphones are arranged in a circle on a plane. In one specific example of implementation, the radius of said circle is two centimetres, and the microphones are omnidirectional.

The sound signal is acquired by said microphones and digitised. This is a synchronous acquisition.

At the end of this first step, four sampled digital signals are obtained.

The second step of the method according to this disclosed embodiment consists of encoding said four sampled digital signals, in an ambisonic-type format of order R, where R is a natural number greater than or equal to one.

It should be remembered that the ambisonic format is a standard audio coding format in a plurality of dimensions.

In the example aspect of the disclosed embodiment described hereinbelow, the order R is equal to one. This first order is used to represent the sound with the following notions: Front-Back and Left-Right.

Figure 4A:
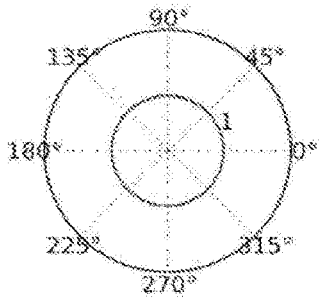
FIGS. 4*a*, 4*b* and 4*c* show the ideal components W, Y and X of a first-order ambisonic format (on the horizontal plane)
Figure 4B:
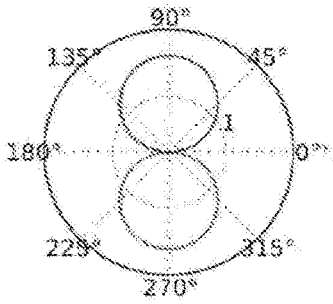
Figure 4C:
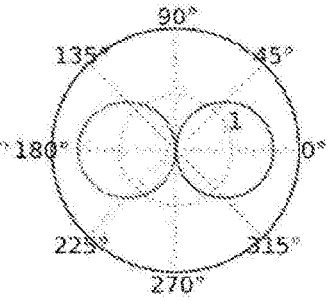

FIGS. 4*a*, 4*b* and 4*c* show the ideal components W, Y and X of a first-order ambisonic format (on the horizontal plane).

Figure 5A:
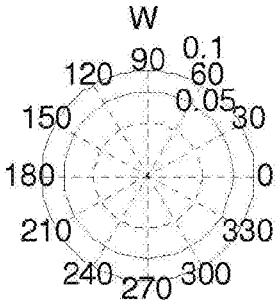
FIGS. 5*a*, 5*b* and 5*c* show the approximate components W, Y and X of a first-order ambisonic format.
Figure 5B:
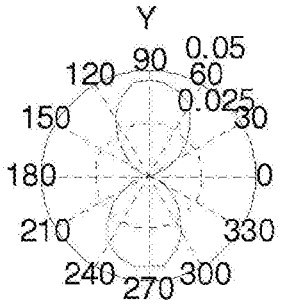
Figure 5C:
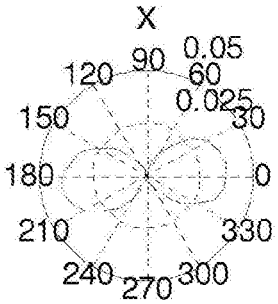

FIGS. 5*a*, 5*b* and 5*c* show the approximate components W, Y and X of a first-order ambisonic format.

Figure 2:
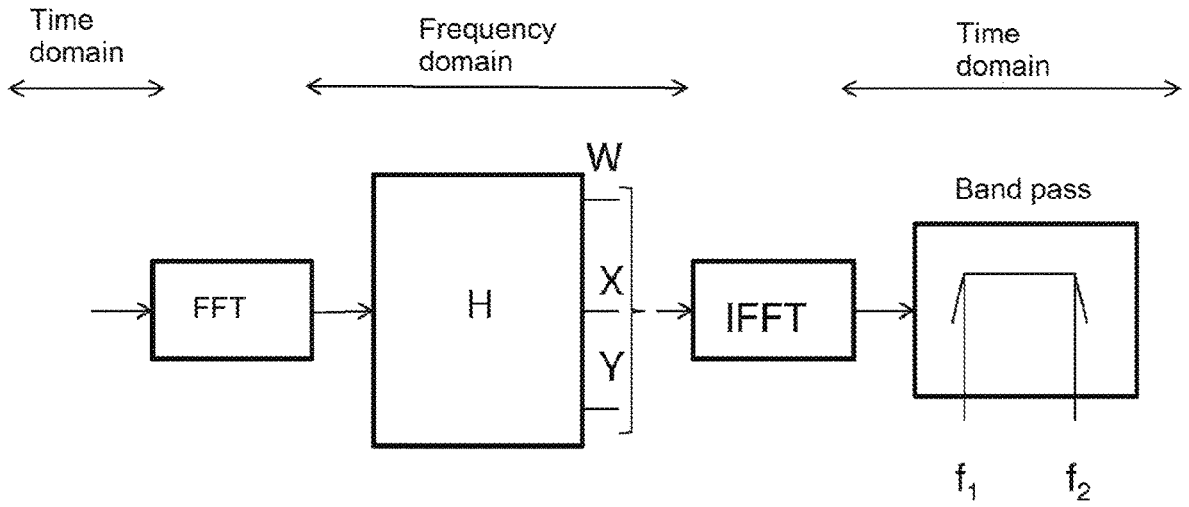
FIG. 2 shows the processing operations applied within the scope of the second step of the method according to this disclosed embodiment.

FIG. 2 shows the processing operations applied within the scope of the second step of the method according to this disclosed embodiment.

FIG. 2 shows that the input data is in the time domain, passes into the frequency domain subsequent to a Fast Fourier Transform (FFT) operation, then the output data is in the time domain subsequent to an Inverse Fast Fourier Transform (IFFT) operation.

Preferably, Hanning windows are used with an overlap by carrying out an "overlap-add"-type function.

FIG. 2 also shows that the input frequency data is modified using a matrix multiplication. This matrix comprises weighting coefficients for each microphone signal and each frequency.

FIG. 2 also shows that filtering using a band-pass filter is carried out on the data before output.

In one aspect of the disclosed embodiment, the method according to this disclosed embodiment implements a band-pass filter filtering frequencies from 100 Hz to 6 kHz. The bass and treble frequencies are thus removed.

In order to calculate the coefficients of the weighting matrix, impulse responses of the N microphones are measured, and in this case of the four microphones, with a source positioned every 5° or every 10° around the network of microphones.

Using a Fast Fourier Transform, the frequency responses of the N microphones are obtained as a function of the angles measured or, in other words, the directivities of the N microphones are obtained as a function of the frequency.

At this stage, the principles of the method disclosed in the international patent application published under number WO 2015/128160 "Method and system for automatic acoustic equalisation" can be used to equalise the frequency responses on the axis of each of the microphones. The same equalisation filters are applied to all microphones and for all angular source positions.

The microphone responses are then placed in a matrix C.

In the frequency domain, for each frequency index k, we obtain $$C_{D\times N}H_{N\times V}=P_{D\times V}$$

where N is the number of microphones (four in this example embodiment), D is the number of angular source positions measured (108 in this example embodiment) and V is the number of ambisonic channels (three in this example embodiment), $C_{D\times N}$ denotes the directivities of the microphones, $H_{N\times V}$ denotes the matrix that transforms the directivities of the microphones into the desired directivities, and $P_{D\times V}$ denotes the directivities prescribed by the ambisonic format (W, X and Y in this example embodiment).

This gives $H_{N\times V}=P_{D\times V}/C_{D\times N}$ for each frequency index k if $C_{D\times N}$ is invertible.

In practice, $C_{D\times N}$ is not invertible. In one aspect of the disclosed embodiment, a method of least squares is implemented to resolve $C_{108\times 4}\cdot H_{4\times 3}=P_{108\times 3}$ The matrix H is defined once for future uses of the network of microphones considered. Subsequently, upon each use, a matrix multiplication is carried out in the frequency domain.

Said matrix H has as many rows as there are microphones, thus four in this example embodiment, and as many columns as required by the order of the ambisonic format used, thus three columns in this example embodiment, in which the first order is implemented on the horizontal plane.

This gives Out=In×H, where H denotes the matrix previously calculated, In denotes the input (audio channels originating from the network of microphones, passed into the frequency domain) and Out denotes the output (Out being converted in the time domain to obtain the ambisonic format).

During this second step, the method according to this disclosed embodiment implements a so-called least squares algorithm for each frequency with, for example, 512 frequency points.

At the end of this second step, data is obtained in the ambisonic format (in this example embodiment, the signals W, X and Y are obtained).

The third step of the method according to this disclosed embodiment consists of delivering the sound signal, thanks to transformation of the data in ambisonic format into two binaural channels.

During this third step, the information relative to the orientation of the head of the user listening to the sound signal, is acquired and exploited. This can be carried out using a sensor in a mobile phone, an audio headset or a virtual reality headset.

This orientation information consists of a vector comprising three angle values known as "pitch", "yaw" and "roll".

In this example embodiment, on one plane, the "yaw" angle value is used.

The ambisonic format is transformed into eight audio channels corresponding to a virtual placement of eight loudspeakers, each placed at 45° about the user.

Figure 6:
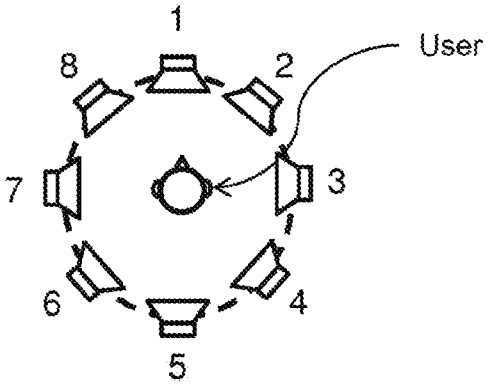
FIG. 6 shows the placement of eight virtual loudspeakers, each positioned at 45° about a user.

FIG. 6 shows the placement of eight virtual loudspeakers, each positioned at 45° about a user.

Each virtual loudspeaker delivers an audio signal originating from the ambisonic components according to the formula:

$$P_n=W+X\cos\theta_n+Y\sin\theta_n \quad (1)$$

where W, X and Y are the data relative to the ambisonic format, and where $\theta_n$ represents the horizontal angle of the $n^{th}$ loudspeaker. For example, in this example embodiment $\theta_0=0°$, $\theta_1=45°$, $\theta_2=90°$, etc.

Then, a filtering step is carried out with a pair of HRTF (head-related transfer functions) per loudspeaker. A pair of HRTF filters (left ear and right ear) are associated with each virtual loudspeaker, then all "left ear" channels and all "right ear" channels are added together to form two output channels.

IIR (Infinite Impulse Response) coefficients are implemented at this stage, said HRTF filters being modelled in the form of IIR filters.

When the user turns his/her head, the position of the virtual loudspeakers is modified. For example, for a head-turn by an angle α, the angle of the virtual loudspeakers becomes $\beta_n=\theta_n-\alpha$. $\theta_n$ is thus replaced by $(\theta_n-\alpha)$ in the formula (1) to calculate the signal delivered by the $n^{th}$ virtual loudspeaker.

Thus, thanks to the method according to this disclosed embodiment, the sound signal can be acquired in all directions, then delivered.

FIG. 3 shows the different steps of the method according to this disclosed embodiment.

This disclosed embodiment further relates to a sound signal processing system, comprising means for:

Synchronously acquiring an input sound signal $S_{input}$ by means of N microphones, N being a natural number greater than or equal to three;

Encoding the said input sound signal $S_{input}$ in a sound data format D, and means for transforming the said input signal into an ambisonic-type format of order R, R being a natural number greater than or equal to one, the said means for transformation into an ambisonic-type format being carried out by means of a Fast Fourier Transform, a matrix multiplication, an Inverse Fast Fourier Transform and by means of a band-pass filter; and Delivering an output sound signal $S_{output}$ by means of digitally processing the said sound data D.

This sound signal processing system comprises at least one computation unit and one memory unit.

The above description of the disclosed embodiment is provided for the purposes of illustration only. It is understood that one of ordinary skill in the art can produce different variations of the disclosed embodiment without leaving the scope of the patent.

What is claimed is:

1. A sound signal processing method comprising:

synchronously acquiring an input sound signal ($S_{input}$) by means of N microphones, N being a natural number greater than or equal to three;

encoding said input sound signal ($S_{input}$) to create sound data (D) in a sound data format, said encoding comprising a sub-step of transforming said input sound signal into an ambisonic-type format of order R, R being a natural number greater than or equal to one, said sub-step of transformation into an ambisonic-type format being carried out by means of a Fast Fourier Transform, a matrix multiplication, an Inverse Fast Fourier Transform and by means of a band-pass filter; and delivering an output sound signal ($S_{output}$) by means of digitally processing said sound data (D);

wherein the matrix multiplication uses a matrix H, where H is calculated applying a method of least squares to a matrix equation CH=P, where C is a matrix of measured directivities of the N microphones and P is a matrix of ideal directivities prescribed by the ambisonic-type format.

2. The sound signal processing method according to claim 1, characterised in that said N microphones are positioned in a circle on a plane, spaced apart by an angle equal to 360°/N or at each corner of a mobile phone.

3. The sound signal processing method according to claim 2, characterised in that said signal processing method implements four microphones spaced apart by an angle of 90° in a horizontal plane.

4. The sounds signal processing method according to claim 1, characterised in that it implements a band-pass filter filtering frequencies from 100 Hz to 6 kHz.

5. The sound signal processing method according to claim 1, characterised in that the order R of the ambisonic-type format is equal to one.

6. The sound signal processing method according to claim 1, characterised in that, during said delivery step, an information item relative to the orientation of the head of a user listening to the sound signal, is exploited.

7. The sound signal processing method according to claim 6, characterised in that acquisition of said information item relative to the orientation of the head of a user listening to the sound signal, is carried out by a sensor in a telephone, an audio headset or a virtual reality headset.

8. The sound signal processing method according to claim 1, characterised in that, during said delivery step, the sound data in ambisonic-type format is transformed into data in binaural format.

* * * * *